US006098564A

United States Patent [19]

Zeilinger

[11] Patent Number: 6,098,564

[45] Date of Patent: Aug. 8, 2000

[54] FLOATING DOCK SECTION

[75] Inventor: Brian K. Zeilinger, Janesville, Wis.

[73] Assignee: Playstar, Inc., Janesville, Wis.

[21] Appl. No.: 09/293,474

[22] Filed: Apr. 15, 1999

Related U.S. Application Data

[60] Provisional application No. 60/082,893, Apr. 24, 1998.

[51] Int. Cl.[7] ..... B63B 35/44

[52] U.S. Cl. ..... 114/263; 114/344

[58] Field of Search ..... 114/263, 344; 14/2.4, 2.5, 27; 405/218–222

[56] References Cited

U.S. PATENT DOCUMENTS

| | | | |
|---|---|---|---|
| 3,831,211 | 8/1974 | Bustamante | 114/344 |
| 4,037,420 | 7/1977 | Wicks | 114/263 |
| 4,706,983 | 11/1987 | Griswold | 114/344 |
| 5,282,435 | 2/1994 | Chapman | 114/263 |

*Primary Examiner*—Jesus D. Sotelo
*Attorney, Agent, or Firm*—Michael Best & Friedrich LLP

[57] ABSTRACT

A dock, pier or floating deck wherein the sections comprising the dock include a wheel support and a wheel mounted thereon to enable easy movement of the dock section over the surface to thereby facilitate placement and removable of the dock section in a body of water.

20 Claims, 2 Drawing Sheets

45
46
36
21
29
30
34
20
32
44
42
40
38
39
48

30
14
20
34
12
32
40

42
50
60
38
39

FLOATING DOCK SECTION

RELATED APPLICATIONS

This application claims priority to provisional application Ser. No. 60/082,893 that was filed on Apr. 24, 1998.

BACKGROUND OF THE INVENTION

The invention relates to a dock or pier, and particularly to a dock or pier having a removable wheel kit attached thereto to facilitate easy movement of the dock or pier over land by an individual.

Docks, piers and decks (hereinafter collectively referred to as "dock") are commonly used as a platform for building structures over water or for berthing watercraft at the dock. Frequently, it is desirable to remove the dock from the water during the winter season. This is especially true in climates where snow and ice can cause extreme wear or even damage to the dock if it is left in the water through the winter season. However, removal of the dock from the water can be very difficult as these structures are often extremely heavy.

SUMMARY OF THE INVENTION

Accordingly, it is an advantage to provide a dock comprised of dock sections each including a bracket, and a wheel assembly removably connected to the bracket to facilitate easy movement of the dock section over land. In one embodiment, the dock section includes a generally vertical end portion. A clevis is mounted on the end portion and a generally vertical support member extends between the tangs of the clevis. The vertical support member includes a through-bore and the tangs of the clevis also include through-bores alignable with the through-bore of vertical support member. A locking pin extends through the through-bores of the clevis and the vertical support member to fix the vertical support member relative to the dock section. The vertical support member includes a lower end, having an axle mounted thereon. A wheel support is mounted on the axle for rotation relative thereto, and a wheel is mounted on the wheel support.

It is a principal advantage of the invention to provide a dock, pier or deck section (and particularly, a floating dock, pier or deck section) having wheels mounted thereon to allow a user to easily move the dock section over land and into and out of a body of water.

It is another advantage of the invention to provide an easily removable wheel kit for a dock section.

It is still another advantage of the invention to provide a wheel kit that is easily connected to the same bracket on the dock section that is used to connect the dock section to yet another dock section.

Various other features and advantages of the invention are set forth in the following drawings, detailed description and claims.

Figure 1:
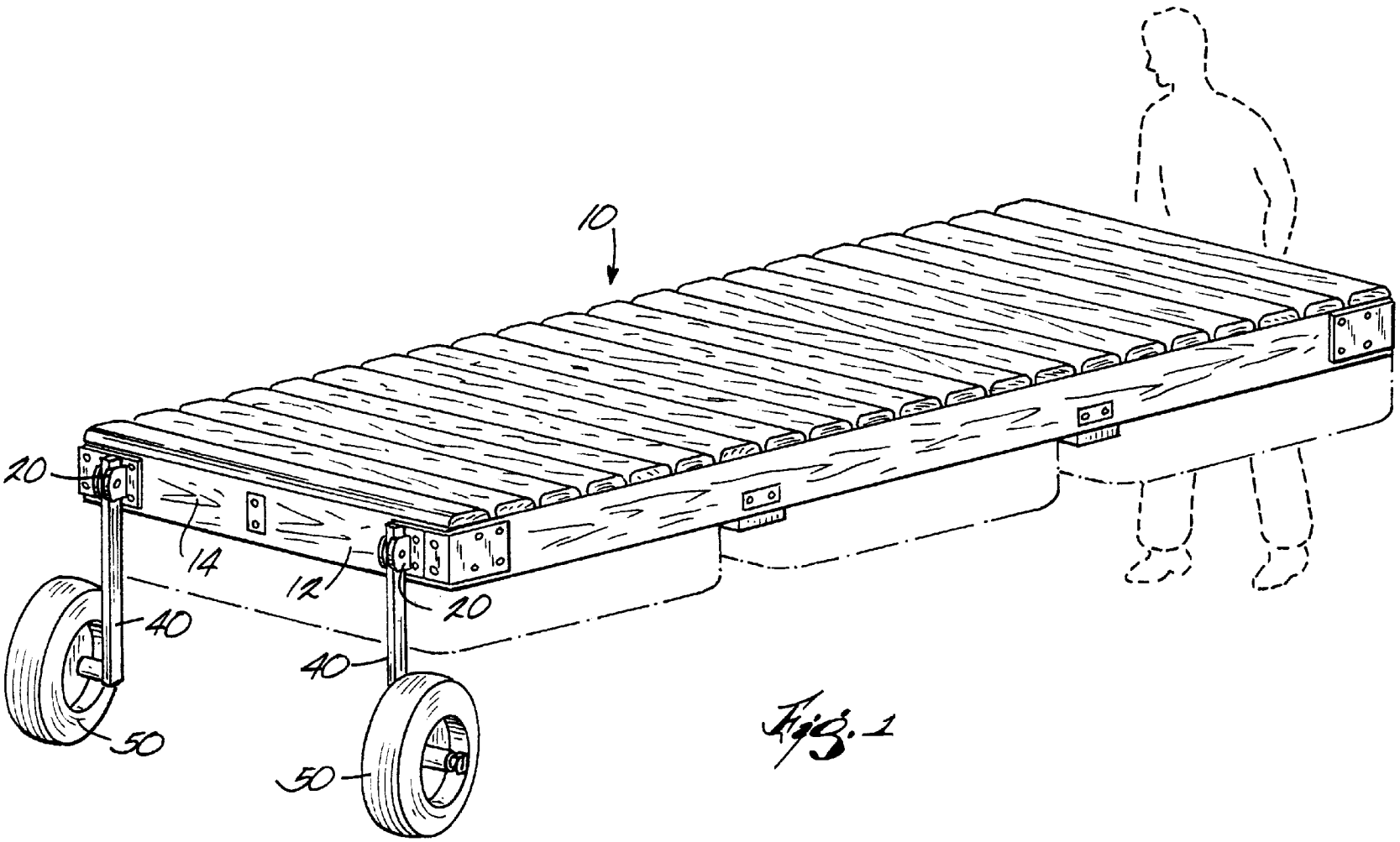
FIG. 1 is a perspective view of a dock embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE DRAWINGS

Shown in FIG. 1 of the drawings is a dock 10 for use on or in a body of water. Typically, such docks (or piers) are used to provide a platform upon which to build a structure over the water or to provide a structure at which to dock and disembark from watercraft. Although the apparatus embodying the invention is equally applicable to any kind of dock, the dock shown in FIG. 1 is a floating dock.

The illustrated dock 10 includes a side portion 12 having a generally vertical surface 14, although it should be understood that the dock 10 can be any configuration which facilitates fabrication, assembly and handling of the dock 10. A pair of devises 20 are mounted on the surface 14. Each of the devises 20 are identical and accordingly only one of the clevises will be described in detail.

Figure 2:
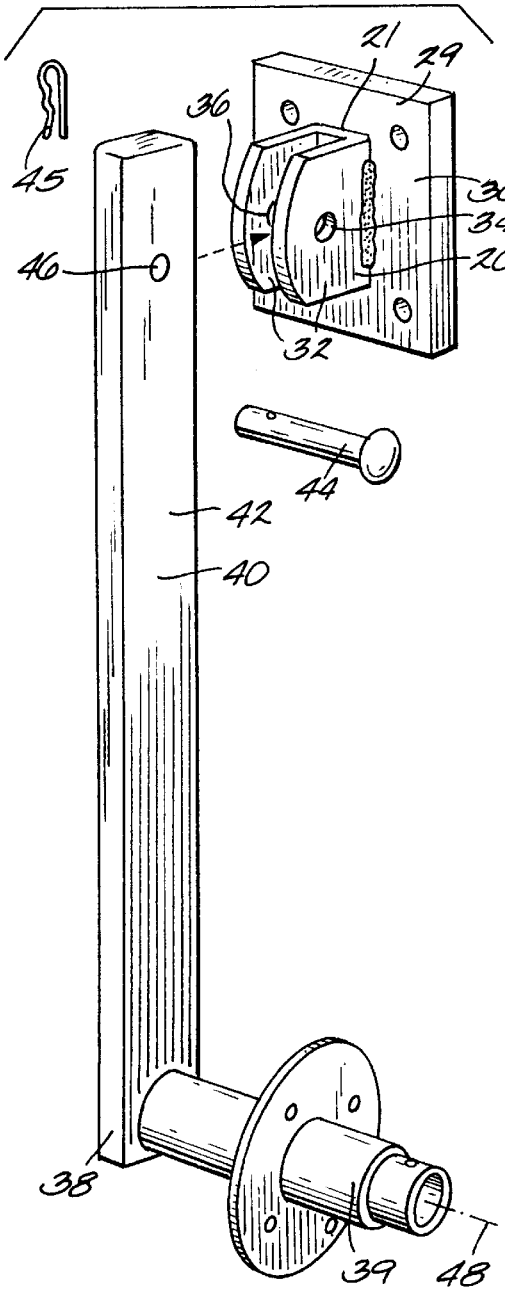
FIG. 2 is an enlarged perspective view illustrating the connection between the base section, clevis and wheel apparatus of the dock.
Figure 3:
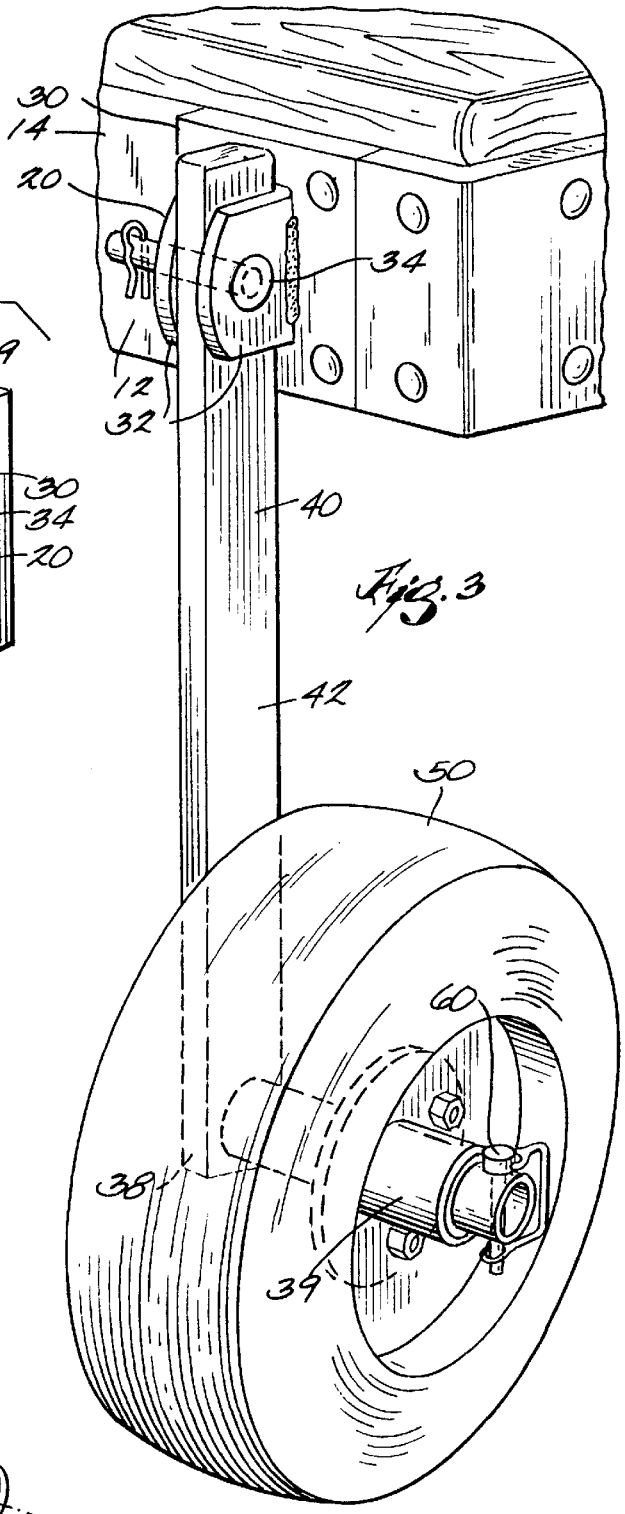
FIG. 3 is an exploded perspective view of a wheel apparatus without the wheel attached.

Referring to FIG. 2, the clevis 20 includes a base 21 and a pair of tangs 32 extending outwardly from the base 21 The clevis 20 is typically connected directly to the surface 14 by some conventional means, or as shown in FIGS. 2 and 3, the base 21 of the clevis 20 is connected by any known method (e.g., welding) to a base portion 30 which is, in turn, connected to the surface 14 using screws, bolts or any other appropriate connector. The tangs 32 are preferably substantially parallel and extend perpendicular to the base 21, although the clevis 20 can be in any configuration that facilitates fabrication. The tangs 32 and the base portion 30 also define a space 34 that is adapted to receive wheel apparatus 40.

FIGS. 2 and 3 illustrate one form of the wheel apparatus 40 that is connected to the clevis 20 of the dock 10. The wheel apparatus 40 includes a vertical support member 42, although it should be understood that other types of support members could also be used. The vertical support member 42 is sized to fit between the tangs 32 of the clevis 20, and includes a through-bore 46 that is axially aligned with the through-bores 34, 36 in the clevis 20. A locking pin 44 extends into the through-bore 34 in one of the tangs 32, and then into the through-bore 46 in the vertical support member 42, and finally into the through-bore 36 in the other tang 32 in order to secure the vertical support member 42 to the dock 10. The locking pin is secured in place using cotter pin 45 or some other known connector.

In alternative embodiments (not shown), a clevis could be mounted on the wheel apparatus 40 and a tang could extend from base portion 30 to fit into the clevis on the wheel apparatus. The wheel apparatus would still be secured in place using locking pin 44 and cotter pin 45.

The vertical support member 42 includes a lower portion 38. An axle 39 is connected to the lower portion 38 and defines an axis 48 (FIG. 2 only). As shown in detail in FIG. 3, a wheel 50 is connected to the axle 39 for rotation about the axis 48. The wheel apparatus also includes a locking pin 60 extending through the axle 39 to secure the wheel 50 to the axle 39.

The wheels 50 support the dock 10 for easy movement across a land surface (see FIG. 1).

The clevises 20 can also be used to connect the dock 10 to an additional dock section (not shown). The additional dock section includes a second frame having a generally vertical surface. A support member is mounted on the surface and projects outwardly from a side portion of the second frame. The support member is dimensioned to fit between the tangs of the clevis 20. The support member includes a through-bore that is aligned with the through-bores 34, 36 in the tangs 32. A locking pin 44 extends through the through-bore of one tang 34 in the clevis 32, through the through-bore in the support member (not shown), and finally through the through-bore 36 of the other tang 32 in order to secure the dock 10 together with the additional dock section.

Various other features and advantages of the invention are set forth in the following claims.

What is claimed is:

1. A floating dock section comprising:

a side portion having a generally vertical surface;

a clevis mounted on said vertical surface, said clevis including a base portion engaging said vertical surface, and a pair of parallel spaced apart tangs extending outwardly from said base portion, each of said tangs including a through-bore formed therein;

a wheel apparatus connected to said clevis, said wheel apparatus including a vertical support member extending between said tangs, said vertical support member including a through-bore aligned with the through-bores of said tangs, said vertical support member further including a lower portion having an axle defining an axis mounted on said lower portion, a wheel mount mounted on said axle for rotation about said axis, and a locking pin connected to said axle to secure said wheel mount to said axle; and a locking pin extending through said tangs and said vertical support member to secure said wheel apparatus to said dock section.

2. A dock section as set forth in claim 1 wherein said dock section further comprises a dock float and a platform mounted on said dock float.

3. A dock comprising:

a frame having a surface;

a clevis mounted to the surface; and a wheel apparatus connected to the clevis.

4. A dock as set forth in claim 3 wherein the frame includes a side portion and the surface is part of the side portion.

5. A dock as set forth in claim 4 wherein the surface is generally vertical.

6. A dock as set forth in claim 3 wherein the clevis includes a base portion that engages the surface, and a pair of spaced apart tangs extending outwardly from the base portion.

7. A dock as set forth in claim 6 wherein the pair of spaced apart tangs are parallel.

8. A dock as set forth in claim 7 wherein each of the parallel spaced apart tangs are perpendicular to the base portion.

9. A dock as set forth in claim 6 wherein the wheel apparatus includes a vertical support member extending between the tangs.

10. A dock as set forth in claim 9 wherein each of the tangs includes a through-bore.

11. A dock as set forth in claim 10 further comprising a locking pin extending through the through-bores and the vertical support member to secure the wheel apparatus to the frame.

12. A dock as set forth in claim 3 wherein the wheel apparatus includes an axle.

13. A dock as set forth in claim 12 further comprising a wheel rotatably mounted on the axle.

14. A dock as set forth in claim 13 further comprising a locking pin connected to the axle for securing the wheel to the axle.

15. A dock as set forth in claim 3 further comprising a float connected to the frame.

16. A dock as set forth in claim 15 wherein the frame includes a bottom surface and the float is mounted to the bottom surface of the frame.

17. A dock comprising:

a first frame having a surface;

a clevis mounted to the surface of the first frame;

a second frame having a surface; and a support member mounted to the surface of the second frame, the support member includes a through-bore that is aligned with through-bores on the clevis; and a locking pin extending through the through-bores of the clevis and the support member in order to connect the first frame to the second frame.

18. A dock as set forth in claim 17 wherein the first frame includes a side portion and the surface of the first frame is part of the side portion, and wherein the second frame includes a side section and the surface of the second frame is part of the side section.

19. A dock as set forth in claim 18 wherein the surface of the first frame and the surface of the second frame are generally vertical.

20. A dock as set forth in claim 17 further comprising a first float mounted on the first frame and a second float mounted on the second frame.

* * * * *

UNITED STATES PATENT AND TRADEMARK OFFICE

CERTIFICATE OF CORRECTION

PATENT NO. : 6,098,564
DATED : August 8, 2000
INVENTOR(S) : Brian K. Zeilinger

It is certified that error appears in the above-identified patent and that said Letters Patent is hereby corrected as shown below:

Column 2,
Line 21, delete "devices" and insert -- clevises --;
Line 21, delete "devices" and insert -- clevises --.

Signed and Sealed this

Tenth Day of July, 2001

Nicholas P. Godici

*Attest:*

*Attesting Officer*

NICHOLAS P. GODICI
*Acting Director of the United States Patent and Trademark Office*